US012611070B2

(12) United States Patent
Bergman et al.

(10) Patent No.: US 12,611,070 B2
(45) Date of Patent: Apr. 28, 2026

(54) DISPENSER SYSTEM AND A METHOD FOR OPERATING A DISPENSER SYSTEM

(71) Applicant: Essity Hygiene and Health Aktiebolag, Gothenburg (SE)

(72) Inventors: Peter Bergman, Gothenburg (SE); Erol Searfoss, Philadelphia, PA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 225 days.

(21) Appl. No.: 18/551,451

(22) PCT Filed: Apr. 8, 2021

(86) PCT No.: PCT/EP2021/059180

§ 371 (c)(1),
(2) Date: Sep. 20, 2023

(87) PCT Pub. No.: WO2022/214181

PCT Pub. Date: Oct. 13, 2022

(65) Prior Publication Data

US 2024/0164593 A1 May 23, 2024

(51) Int. Cl.
*A47K 5/12* (2006.01)

(52) U.S. Cl.
CPC ..... *A47K 5/1207* (2013.01); *A47K 5/1211* (2013.01)

(58) Field of Classification Search
CPC ..... A47K 5/1207; A47K 5/1211; A47K 5/12; A47K 5/1202; B05B 11/1008
See application file for complete search history.

(56) References Cited

U.S. PATENT DOCUMENTS 3,613,952 A 10/1971 Portyrata et al.
3,666,142 A 5/1972 Gust
(Continued)

FOREIGN PATENT DOCUMENTS

CA 2261178 C 7/2002
CA 3074778 A1 * 9/2020 ..... B05B 11/1087
(Continued)

OTHER PUBLICATIONS

Internatonal Search Report & Written Opinion for International Application No. PCT/EP2021/059180; International Filing Date: Apr. 8, 2021; Date of Mailing: Dec. 20, 2021; 60 pages.
(Continued)

*Primary Examiner* — Bob Zadeh
(74) *Attorney, Agent, or Firm* — CANTOR COLBURN LLP

(57) ABSTRACT

A dispenser system includes a dispenser having a housing and an actuator, a liquid container disposed in the housing, a pump operably connected to the dispenser, and an adjuster. The actuator is configured to be manually operated to manually activate the pump to discharge liquid from the liquid container. The actuator is formed with a front side and a rear side facing the rear of the dispenser. The adjuster is configured to selectively limit a displacement of the actuator to define a corresponding predetermined maximum dose volume when the liquid is being discharged from the liquid container. The adjuster is movable between at least a first position and a second position.

12 Claims, 9 Drawing Sheets

(56) References Cited

U.S. PATENT DOCUMENTS

| | | | | | |
|---|---|---|---|---|---|
| 4,036,406 | A * | 7/1977 | Jespersen | G01F 11/025 137/853 |
| 4,238,056 | A | 12/1980 | Gains et al. | |
| 4,437,585 | A | 3/1984 | Banks | |
| 4,493,440 | A * | 1/1985 | von Buelow | A47K 5/1204 222/375 |
| 4,662,195 | A | 5/1987 | Von et al. | |
| 4,667,854 | A * | 5/1987 | McDermott | A47K 5/1215 222/181.2 |
| 4,895,276 | A | 1/1990 | Maldonado | |
| 4,987,653 | A | 1/1991 | Lin | |
| 5,022,556 | A | 6/1991 | Dency et al. | |
| 5,033,657 | A * | 7/1991 | Whittington | B67D 1/10 222/309 |
| 5,265,772 | A | 11/1993 | Bartasevich et al. | |
| 5,398,845 | A | 3/1995 | Meyer | |
| 5,465,877 | A | 11/1995 | Bell et al. | |
| 6,189,740 | B1 * | 2/2001 | Wade | A47K 5/1215 222/207 |
| 7,954,677 | B2 | 6/2011 | Langlois et al. | |
| 8,109,411 | B2 | 2/2012 | Yang et al. | |
| 8,342,369 | B2 | 1/2013 | Hsu | |
| 8,371,474 | B2 | 2/2013 | Tramontina et al. | |
| 8,678,240 | B2 | 3/2014 | O'Brien | |
| 8,827,120 | B2 | 9/2014 | Boshuizen et al. | |
| 8,851,331 | B2 | 10/2014 | Pelkey et al. | |
| 9,149,161 | B2 | 10/2015 | Ophardt et al. | |
| 9,380,916 | B2 | 7/2016 | Allef et al. | |
| 9,655,478 | B2 | 5/2017 | Muderlak et al. | |
| 9,694,376 | B2 | 7/2017 | Böhm et al. | |
| 10,034,583 | B2 | 7/2018 | Carignan et al. | |
| 10,034,585 | B2 | 7/2018 | Moore et al. | |
| 10,219,656 | B2 | 3/2019 | Pelfrey et al. | |
| 10,893,780 | B2 | 1/2021 | Ophardt et al. | |
| 10,948,326 | B2 | 3/2021 | Moore | |
| 11,092,472 | B2 | 8/2021 | Ophardt et al. | |
| 11,213,844 | B2 | 1/2022 | Ciavarella | |
| 11,744,412 | B2 | 9/2023 | Butler | |
| 2007/0000941 | A1 | 1/2007 | Hadden et al. | |
| 2011/0079614 | A1 | 4/2011 | Ganzeboom et al. | |
| 2012/0006848 | A1 | 1/2012 | Reynolds | |
| 2012/0237377 | A1 | 9/2012 | Richardt et al. | |
| 2012/0241470 | A1 | 9/2012 | Snodgrass et al. | |
| 2012/0298698 | A1 | 11/2012 | Lee | |
| 2017/0251884 | A1 * | 9/2017 | Carignan | A47K 5/1217 |
| 2019/0001358 | A1 | 1/2019 | Lee | |
| 2024/0164593 | A1 * | 5/2024 | Bergman | A47K 5/1211 |

FOREIGN PATENT DOCUMENTS

| | | | | |
|---|---|---|---|---|
| CN | 210493901 | U | 5/2020 | |
| CN | 210582312 | U | 5/2020 | |
| CN | 213371671 | U | 6/2021 | |
| CN | 215424326 | U | 1/2022 | |
| DE | 4401179 | A1 * | 7/1995 | A47K 5/1205 |
| DE | 20320332 | U1 | 6/2004 | |
| DE | 102020214977 | A1 | 6/2022 | |
| EP | 2644280 | A2 * | 10/2013 | B05B 11/1008 |
| EP | 3372962 | A1 | 9/2018 | |
| EP | 3636123 | A1 * | 4/2020 | A47K 5/1207 |
| GB | 1329498 | A | 9/1973 | |
| GB | 2165316 | A | 4/1986 | |
| GB | 2243184 | A | 10/1991 | |
| JP | 2008265776 | A | 11/2008 | |
| JP | 2009298422 | A | 12/2009 | |
| JP | 5111079 | B2 | 12/2012 | |
| WO | 2005005058 | A1 | 1/2005 | |
| WO | 2007125365 | A1 | 11/2007 | |
| WO | 2021231295 | A1 | 11/2021 | |
| WO | 2023102618 | A1 | 6/2023 | |

OTHER PUBLICATIONS

CN First Office Action with English Translation; Application No. 202180093564.2; Date Mailed: Jun. 13, 2025; pp. 1-16.

National Intellectual Property Administration (CNIPA) of the People's Republic of China, Application No. 202180093564.2, mailed Jan. 6, 2026, with English Translation, 15 pages.

Columbian Office Action, Application No. PCT/EP2021/059180, mailed Jan. 5, 2026, with English Translation, 34 pages.

* cited by examiner

DISPENSER SYSTEM AND A METHOD FOR OPERATING A DISPENSER SYSTEM

CROSS REFERENCE TO RELATED APPLICATIONS

This application is a National Stage Application of PCT/EP2021/059180, filed Apr. 8, 2021, which is incorporated by reference in its entirety herein.

TECHNICAL FIELD

The disclosure relates to a dispenser system, a dispenser and a method for operating a dispenser system.

BACKGROUND

Dispensers for liquids such as soap and similar hygiene products are well known. The general purpose of such dispensers is to contain and dispense various types of liquid. Today's dispensers are used in homes, offices, hospitals, restaurants, airports and other types of environments. Furthermore, such dispensers may be arranged for dispensing different types of liquids such as soap, sanitizers, lotions, shampoo, skin care products or other types of liquids.

Furthermore, dispenser systems of the type which contain a dispenser and a replaceable liquid container are widely used. The use of a replaceable liquid container, for example for soap, allows users to replace an empty container with a new and filled container in a simple manner.

A liquid dispenser system may comprise a dispenser with a housing which accommodates such a replaceable liquid container, which is also referred to as a "refill unit", or "refill cartridge". As the fluid is discharged from the liquid container, the remaining amount of fluid will gradually decrease. Eventually, the liquid container needs to be removed and replaced with a new one.

Furthermore, it is known to incorporate a pump unit, for example a foam pump unit, either in the replaceable liquid container or in the actual dispenser housing. Such a foam pump unit is previously known as such and is configured to transfer the liquid, such as for example soap, from the liquid container and discharge it out of the dispenser in the form of a foam.

Furthermore, a dispenser system may be activated by a user by means of a suitable actuator which can be either manual or automatic. A manual actuator can for example be in the form of a push button or a lever which is arranged to activate a dispensing mechanism. The purpose of such a device is to allow a user to actuate the dispenser system so as to discharge a certain amount of the liquid which is contained inside the liquid container. Alternatively, an automatic actuator can for example comprise a touch-free sensor device, such as an infrared sensor, which is configured to automatically actuate an electric motor for operating a pump unit upon detection of the presence of a user.

In those dispenser systems in which a manually operated actuator is used, a certain amount, or dose, of liquid will be dispensed upon actuation. Obviously, the volume of each dose of liquid may be consistent and in accordance with predetermined specifications.

In some cases, there may be a requirement to adjust the volume of liquid in a dose which is dispensed from the container each time the dispenser is actuated. This may for example be due to the fact that different types of liquids which are used in the dispenser may require different volumes in order to produce a standard dose, i.e. a default dose, and for providing suitable cleaning properties. This requirement may also be due to the fact that there may be different needs for liquid material in different environments, for example in a restaurant or a hotel, as compared with an industrial site or within a manufacturing process.

In summary, the dispenser may need an ability to control the amount of liquid material which is discharged from the dispenser as a dose. This can be accomplished by arranging a dispenser in a manner which allows an increase or decrease of a maximum amount of liquid material which is discharged by means of the pump unit.

U.S. Pat. No. 8,827,120 discloses a manually operated dispenser that includes a pump which is provided with a stroke restrictor. The stroke restrictor comprises an elongated rod with a plurality of arms of at least two different lengths which may assume different rotational positions. Furthermore, the dispenser comprises an actuator in the form of a handle with two lifting members which, upon actuation of the handle, may force a housing piece to move upward. The housing piece is connected to the pump. Also, the stroke length of the housing piece is determined by the rotational position of the stroke restrictor. The stroke restrictor operates as a blocking member which may limit an upward movement of the housing piece.

Depending on the rotational position of the "stroke restrictor", the displacement of the actuating device, and consequently also the dose, which is dispensed, can be controlled.

Notwithstanding the above, there is a need for more simple solutions which are reliable, which contain few parts, and which are easy to use in order to adjust the dose.

Consequently, there is a need for further improvements within the technical field of liquid dispenser systems.

SUMMARY

In accordance with the disclosure, there is provided a dispenser system having a purpose of solving one or more of the drawbacks of known devices within this field.

In particular, the dispenser system according to the disclosure provides alternatives or improvements within the field of dispenser systems by providing an adjustment of the liquid volume of a dose from the dispenser, in particular for systems having a manual actuator which is associated with a displacement adjusting device which is configured for controlling the dose.

In accordance with the disclosure, there is provided a dispenser system comprising a dispenser, a liquid container and a pump, the dispenser comprising a housing and an actuator which is configured for a user to manually activate the pump for discharging liquid from the liquid container, the actuator being formed with a front side facing the user and a the side facing the rear of the dispenser; and an adjuster for selectively limiting the displacement of the actuator and thereby defining a corresponding predetermined maximum dose volume during the discharging of liquid. The adjuster is movable between at least a first position and a second position, wherein the adjuster acts on the rear side in the first position to limit the displacement of the actuator to a corresponding first displacement length, and wherein the actuator is configured with a second displacement length in the second position.

Certain advantages are achieved by means of the dispenser system according to the disclosure. In particular, the adjuster is arranged to assume at least two positions. For at least the first one of these positions, the actuator will be limited to a specific displacement length due to the fact that the adjuster comes into contact with the rear side of the actuator. Further displacement lengths can be defined through the second position, or alternatively through the maximum stroke of the pump or through further suitable configurations of the dispenser. Each one of the displacement lengths corresponds to a predetermined dose volume from the dispenser. In this manner, it can be controlled how far the actuator will be allowed to be moved during actuation by a user. This controls the dose for each actuation of the dispenser. In other words, the maximum liquid volume of a dose from the dispenser can according to the disclosure be controlled by controlling the maximum displacement length of the actuator.

Furthermore, the dispenser system according to the disclosure provides for a simple and reliable solution. The adjuster as defined above has few parts and is easy to switch between its different positions.

According to an embodiment, the adjuster may be pivotably arranged about a rotational axis and arranged to selectively assume at least two rotational positions corresponding to said at least first and second positions.

The rear side of the actuator may be formed with at least one protrusion which is aligned to come into contact with the adjuster in at least one of its positions, thereby defining a corresponding first displacement length of the actuator.

The second position may correspond either to a condition of the pump in which it has reached its maximum stroke length or to a condition in which a portion of the rear side of the actuator is aligned to come into contact with a support structure of the dispenser or with the adjuster, thereby limiting the second displacement length of the actuator. The portion of the rear side may be the protrusion formed at the rear side of the actuator. The protrusion may be allowed to be positioned in a recess in the support structure of the dispenser, thereby limiting the second displacement length of the actuator. The support structure may be formed at a lower portion of a second portion of the dispenser. The second portion may correspond to a rear side of the housing.

The protrusion may be formed so that the second displacement length exceeds the first displacement length.

The adjuster may be generally rectangular and pivotably arranged about the rotational axis. An advantage with this configuration is that it defines a stable and flexible device with a handle, for moving the adjuster between its different positions. It also provides a proper and reliable functionality for providing a stop element for the actuator and the displacement thereof.

The adjuster may comprise a cross element which is generally shaped so as to conform to the rear side of the actuator.

The adjuster may comprise at least one contact surface which is configured to be in contact with the actuator in the first position of the adjuster.

The pump may be an integrated pump unit in the liquid container and may be actuated for discharging liquid as a result of pressure being exerted upon the front side of the actuator.

The first position may correspond to a relatively low dose of volume being dispensed and the second position may correspond to a relatively high volume being dispensed.

The actuator may comprise a pump actuator element which is configured for actuating an annular flange on the pump unit, thereby initiating dispensing.

The liquid container may be arranged so as to block access to the adjuster when the liquid container is mounted, and the dispenser is closed.

The disclosure also relates to a dispenser suitable for use in a dispenser system as defined above. The dispenser comprises an actuator which is configured for a user to manually activate the pump for discharging liquid from the liquid container, the actuator being formed with a front side facing the user and a rear side facing the rear of the dispenser; and an adjuster for selectively limiting the displacement of the actuator and thereby defining a corresponding predetermined maximum dose volume during the discharging of liquid; wherein the adjuster is movable between at least a first position and a second position, wherein the adjuster acts on the rear side in the first position to limit the displacement of the actuator to a corresponding first displacement length, and wherein the actuator is configured with a second displacement length in the second position.

The present disclosure also provides a method for operating a dispenser system comprising a dispenser, a liquid container and a pump. The method comprises enabling manual activation of the pump by a user and by means of an actuator with a front side facing the user and a rear side facing the rear of the dispenser, so as to discharge liquid from the liquid container; and enabling selective limitation of the displacement of the actuator by means of an adjuster, thereby defining a corresponding predetermined dose volume during the discharging of liquid. The method further comprises allowing movement of the adjuster between at least a first position and a second position by selectively bringing the adjuster to act on the rear side of the actuator in at least the first position having a corresponding first displacement length, and wherein the second position corresponds to a second displacement length; and thereby limiting the displacement of the actuator to at least the corresponding first displacement length and the second displacement length, respectively.

Further advantages and advantageous features of the embodiments contemplated herein are disclosed in the following description and in the appended claims.

In the following, the term "dispenser system" is used to indicate an apparatus comprising at least a dispenser, a liquid container, and a pump unit.

Also, as used herein, the terms "horizontal", "lateral" and "vertical", "uppermost" and "lowermost", "downwards" and "upwards", "front" and "rear", and "upper" and "lower", or the like, are to be understood as seen when a dispensing system with a dispenser and fluid container is arranged for use.

BRIEF DESCRIPTION OF THE FIGURES

The disclosure will be described in greater detail below with reference to the figures shown in the appended drawings.

DETAILED DESCRIPTION OF PARTICULAR EMBODIMENTS

Different aspects of the present disclosure will be described more fully hereinafter with reference to the enclosed drawings. The disclosure can be realized in many different forms and should not be construed as being limited to the embodiments below.

Figure 1:
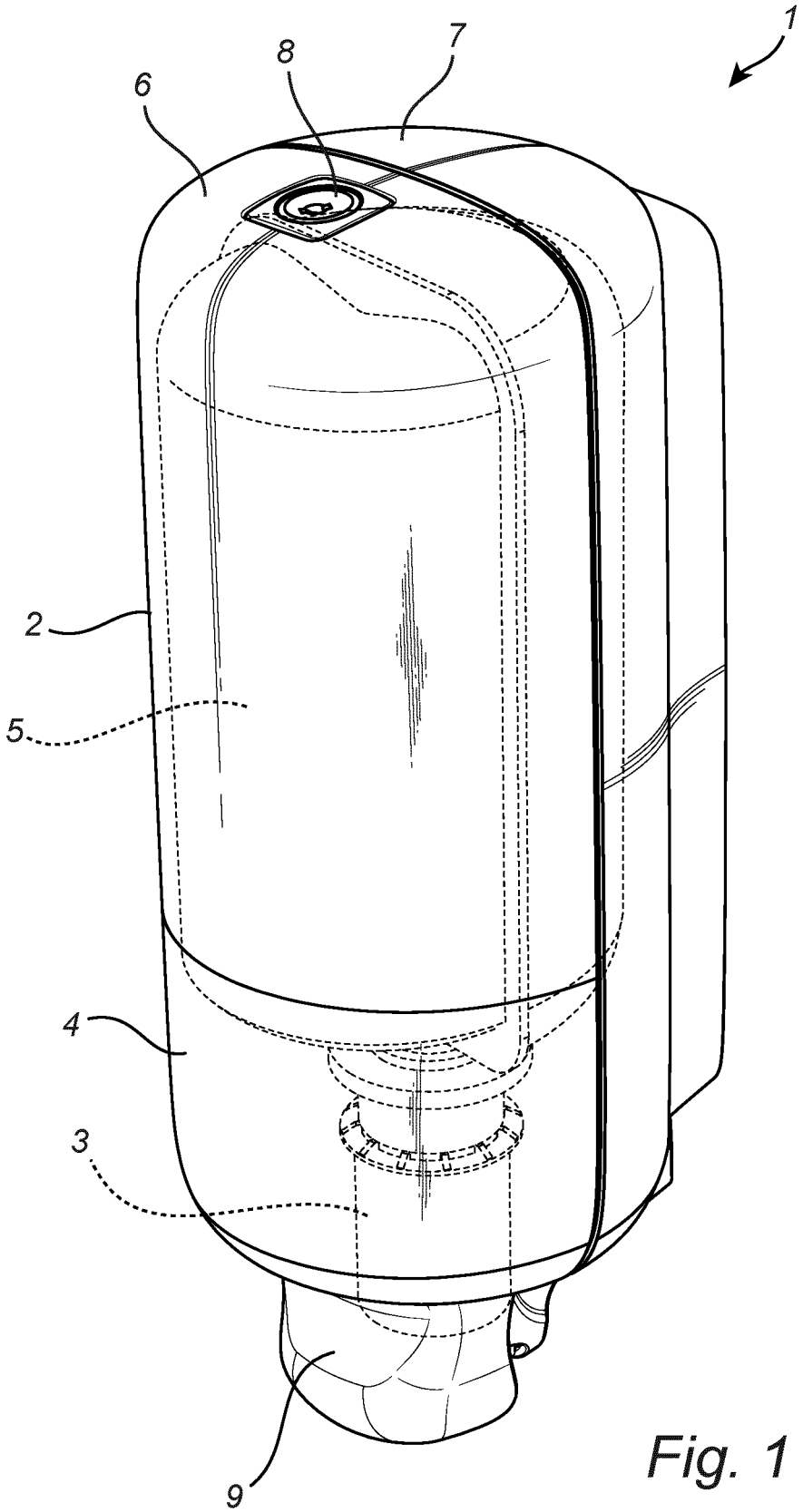
FIG. 1 shows a perspective view of a dispenser system according to the disclosure.

With initial reference to FIG. 1, there is shown a perspective view of a dispenser system 1 for dispensing a liquid such as for example soap. The dispenser system 1 can alternatively be used for other liquids such as a sanitizer, lotion, shampoo, skin care product, detergent, disinfectant, moisturizer, alcogel or a similar liquid, or alternatively fluids such as a dispersion (for example an aerosol). The dispenser system 1 is arranged so that a liquid can be discharged in the form of a fluid, a gel, a foam, a spray or similar, and is also arranged for being placed in a location where the liquid is intended to be used, e.g. a bathroom, a hospital room or a kitchen.

According to an example embodiment which is shown in the drawings, the dispenser system 1 comprises a dispenser 2 that is used for dispensing soap which is processed so as to be discharged as foam. To this end, the dispenser 2 can be actuated by means of a pump unit 3 which is a foam pump unit, and which is shown with broken lines in FIG. 1. The pump unit 3 will be described in greater detail below. According to further embodiments, the dispenser system 1 can be provided with a pump unit which discharges spray or liquid, i.e. as an alternative to foam.

The dispenser 2 shown in FIG. 1 comprises a housing 4 which is configured for containing a liquid container 5 (shown with broken lines in FIG. 1), suitably in the form of a replaceable refill unit, i.e. a container for a liquid such as for example soap which is configured so as to be easily removed from the dispenser when it is empty, thereby allowing replacement with a new liquid container.

The housing 4 comprises a first portion 6 and a second portion 7 which are hingedly coupled to each other, suitably along the bottom of the housing 4, and which can be locked together by means of a lock 8. Other fastening means between the first portion 6 and the second portion 7 are also possible. The first portion 6 corresponds to a front side of the housing 4 whereas the second portion 7 corresponds to a rear side of the housing 4 which is arranged for mounting for example on a wall.

Other designs for opening the housing 4 are also possible within the scope of this disclosure. Furthermore, the housing 4 may be made of any suitable material, for example plastic or metal.

The dispenser 2 is provided with an actuator 9 which is configured for dispensing liquid or fluid out of the liquid container 5 by actuating the pump unit 3. The embodiment shown in FIG. 1 comprises an actuator 9 in the form of a manual push button. A user who wishes to discharge an amount of soap will have to push the actuator 9, which causes discharge of a liquid from the liquid container 5 in a manner which will be described in greater detail below.

Figure 2A:
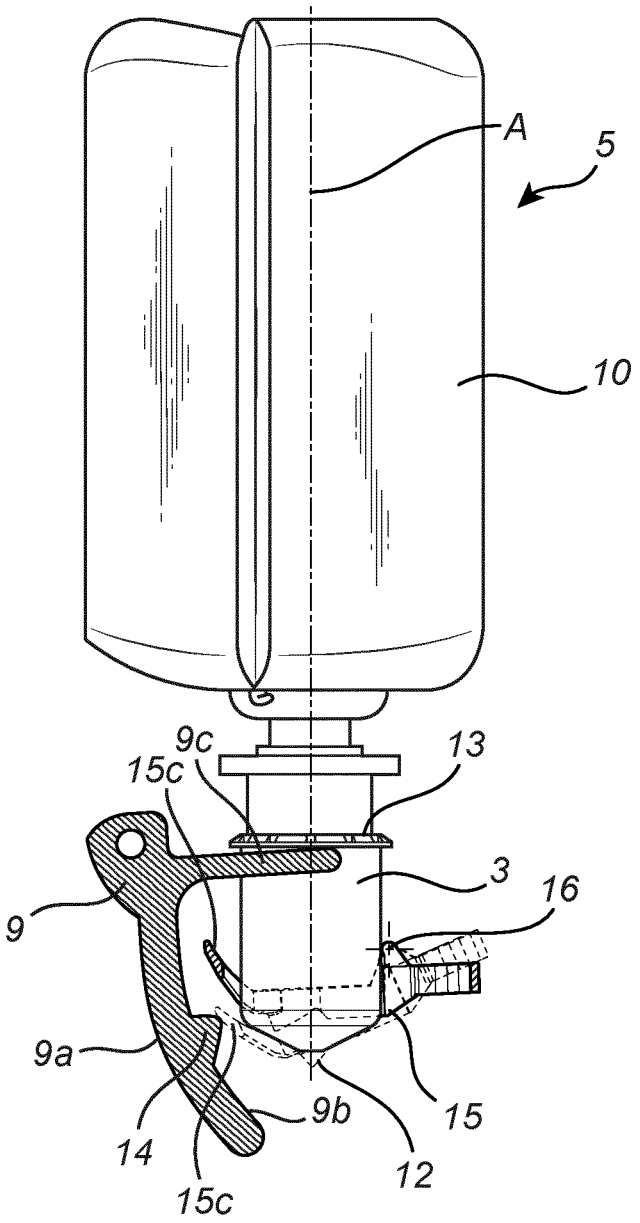
FIG. 2A shows a side view of a liquid container for a dispenser system according to FIG. 1, in a first operating mode.

FIG. 2A shows the replaceable liquid container 5, which is intended to be used with the dispenser 2 shown in FIG. 1. The liquid container 5 is designed for storing and transporting liquid prior to use in the dispenser 2. The liquid container 5 is also designed to be inserted and fitted into the dispenser 2 for dispensing of the liquid. The example liquid container 5 is designed to be used in dispensers of the type in which the dispensing takes place from the bottom of the dispenser. When the liquid container 5 is empty, it may be removed and replaced with a new container. Typically, such a replaceable liquid container 5 has an integral pump unit 3.

According to further embodiments, the dispenser system 1 may comprise a liquid container of the type which can be refilled, i.e. which does not have to be replaced with a new liquid container when it is empty. In order to simplify the refilling of the liquid container 5, the pump unit 3 is suitably configured for being removably attached to the container 5.

The liquid container 5 comprises a liquid reservoir 10 which is arranged to be connected to the pump unit 3. The pump unit 3 ends with a dispensing opening 12. The liquid reservoir 10 is the portion of the liquid container 5 in which liquid is stored. The reservoir may be a collapsible reservoir as illustrated in FIG. 2A. An example of a collapsible reservoir that may be used in the liquid container is described in WO 2011/133085.

In FIG. 2A, the liquid reservoir 10 is shown as having a generally cylindrical form, but other three-dimensional forms are also possible. The reservoir 10 is consequently hollow until it is filled with a liquid and is made of a material which is suitable for the liquid contained, without degradation of the liquid or the liquid reservoir 10. Suitable materials for the liquid reservoir 10 are plastics, for example polyethylene or polypropylene.

Furthermore, the liquid container 5 is associated with the pump unit 3, which in the illustrated embodiment is in the form of a foam pump unit 3, which acts to transfer liquid from the liquid reservoir 10 and dispense it in the form of foam. To this end, the liquid reservoir 10 is connected to and in fluid communication with the dispensing opening 12 through which the foamed liquid is discharged. A foam pump unit 3 for a liquid dispenser of the kind mentioned above is previously known and for that reason is not described in any greater detail here. An example of a foam pump unit 3 that may be used for the liquid container is described in the patent document WO 2011/133085. According to alternative embodiments, pump units for discharging liquids or spray may also be used. For example, a known pump unit that may be used for this purpose is disclosed in WO 2018/177519.

It should be mentioned that activation of the pump unit 3 by displacing its lower portion upwards, i.e. in a generally vertical direction, discharges a quantity of liquid in the form of a foam from the liquid reservoir 10 via the dispensing opening 12. Consequently, the pump unit 3 is configured with a predetermined stroke length which determines the amount of liquid which is displaced. This vertical displacement is carried out by forcing an annular flange 13, extending around the pump unit 3, in an upwards direction. As illustrated in FIG. 2A, the pump unit 3 is located at one end of the liquid reservoir 10, and the generally vertical direction corresponds to an extension of the longitudinal axis of the cylindrical liquid reservoir 10, as indicated with reference A in FIG. 2A.

The contents of the liquid container 5 can be discharged in many forms, suitably but not limited to foam, spray, gel, lotion or similar. Different types of contents in the liquid container 10 and different methods of discharging those contents may require different types of pump units, which should be adapted to the contents of the liquid container 10. This means that the disclosure is not limited to dispenser systems with a pump unit as described with reference to FIG. 2A but can be implemented with other types of pump units, as also mentioned herein.

FIG. 2A shows the actuator 9 and the pump unit 3 in a first operating mode, more precisely in a non-actuated operating mode in which no liquid is dispensed from the liquid container. Furthermore, the pump unit 3 may be activated mechanically by means of the actuator 9 when a user wishes to dispense a liquid such as soap. More precisely, the actuator 9 is arranged in a pivotable manner in the dispenser 2. Also, the actuator 9 comprises a front side 9*a*, which is configured so that a user may push on it, and a rear side 9*b* facing the second portion 7 of the dispenser 2. The actuator 9 also comprises a pump actuator element 9*c*, which is configured so as be positioned below the annular flange 13 extending around the pump unit 3 when the actuator 9 is in a stand-by mode or condition. In this manner, the dispenser 2 can be actuated manually by means of the actuator 9 being displaced directly by a user so that the pump actuator element 9*c* acts in an upwards direction on the flange 13 thereby allowing a generally axial and vertical compression of the pump unit 3.

Figure 2B:
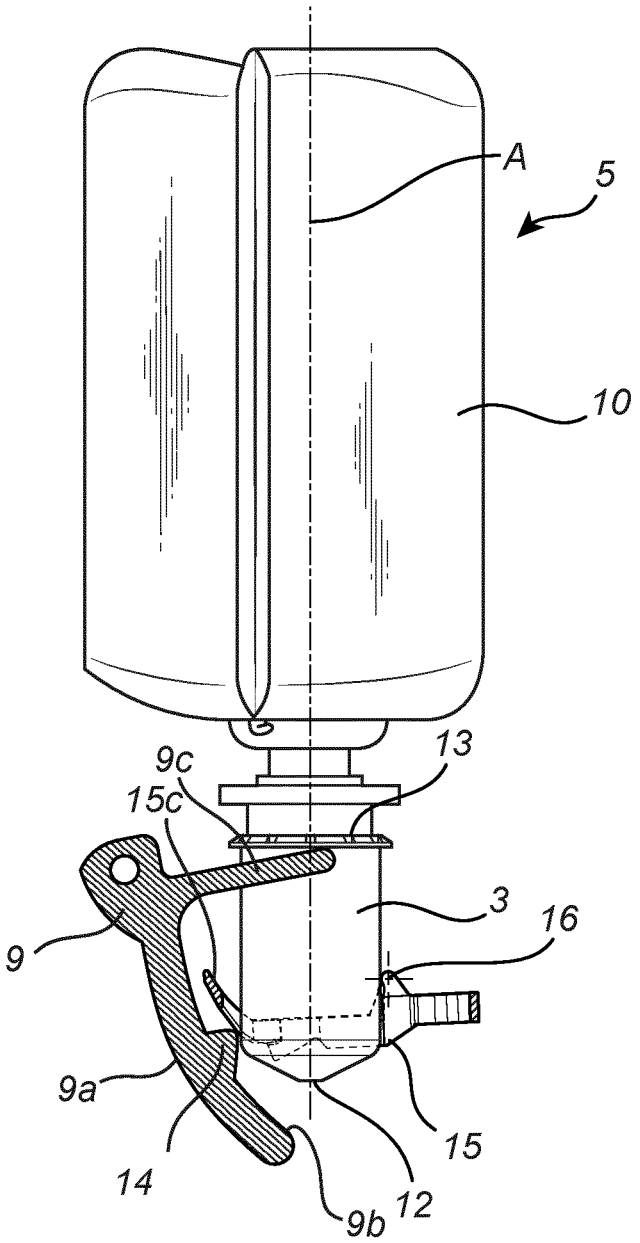
FIG. 2B shows the arrangement according to FIG. 2A but in second operating mode.

Furthermore, FIG. 2B shows the dispenser when the actuator 9 is actuated manually by the user who pushes on the front side 9*a* in a substantially lateral direction directed toward the rear of the dispenser 2. In this manner, the actuator 9 and the pump unit 3 will assume a second operating mode in the form of an actuated operating mode.

As mentioned above, the maximum volume of liquid which is dispensed as a single dose from the liquid reservoir 10 each time the dispenser is actuated by a user can be controlled. This requirement may occur due to the fact that different types of liquids may require different volumes in a default dose, or that the dispenser system in question is placed in an environment which requires a particular dose volume. For this reason, the dispenser system 1 may be configured so as to control the amount of liquid material that is discharged each time it is actuated. For this reason, the rear side 9*b* of the actuator 9 is provided with a protrusion 14 which is shown in a simplified and schematical manner in FIGS. 2A, 2B and 2C but which also will be described further below with reference to FIG. 3. The protrusion 14 cooperates with an adjuster 15, suitably configured as a displacement adjustment device which is arranged to limit the displacement of the actuator 9 in a manner so that a predetermined maximum displacement of the actuator 9 and a predetermined maximum dose volume will be defined during said displacement.

Figure 2C:
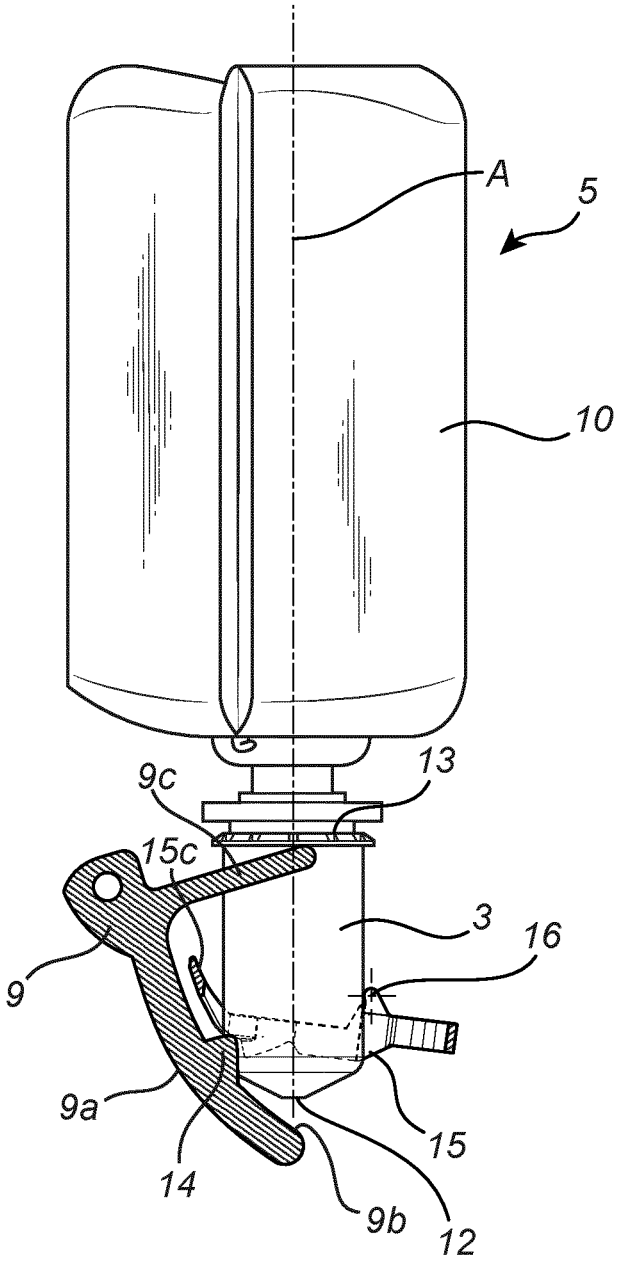
FIG. 2C shows the arrangement according to FIG. 2A, in a third operating mode.

FIG. 2B shows the actuator 9 in an actuated operating mode in which the protrusion 14 of the actuator 9 is in direct contact with the adjuster 15 in order to limit the displacement of the actuator 9 to a displacement length which corresponds to a first predetermined dose volume and which also corresponds to a first stroke length of the pump unit 3. Furthermore, FIG. 2C shows the actuator 9 in a second actuated operating mode in which the adjuster 15 has been moved to a second position in which the actuator 9 is allowed to rotate slightly further in a counter-clockwise direction. In this position, the protrusion 14 is also in contact with the adjuster 15 in order to limit the displacement of the actuator 9. However, through the rotation of the actuator 9, the protrusion 14 will come into contact with the adjuster 15 after having displaced the actuator 9 further than shown in FIG. 2B. According to FIG. 2C, movement of the actuator 9 provides a second predetermined maximum dose volume which corresponds to a second stroke length of the pump unit 3 and a corresponding higher dose volume which is dispensed. As will be explained below, this disclosure comprises embodiments in which the adjuster 15 is in contact with the rear side 9*b* of the actuator 9 in a first position of the adjuster 15 and in which the adjuster 15 may be—but does not have to be—in contact with the rear side 9*b* in the second position of the adjuster 15. In fact, other parts of the dispenser 2 than the adjuster 15 may be configured for limiting the displacement of the actuator 9.

It should be noted that in the illustrated example embodiments, the actuator 9 is displaced substantially laterally and pivotally, whereas the pump unit 3 is generally moved axially and vertically during operation.

According to a further embodiment, which is not shown in the drawings, the dispenser is not arranged to limit the displacement of the actuator 9. Instead, it is the maximum stroke length of the pump unit 3 which will limit the displacement of the actuator 9 and consequently also control the dose amount.

The adjuster 15, which is shown in a side view in FIGS. 2A, 2B and 2C, will now be described with particular reference to FIG. 3.

Adjuster 15 is movable between at least a first position and a second position, different from the first position, so as to act on the rear side 9*b* of the actuator 9 in a least the first position, but not necessarily in the second position. In particular, the adjuster 15 can be moved in a manner so as to limit the displacement of the actuator 9 to at least a first displacement length and a second displacement length, respectively. According to an embodiment shown in the drawings, the adjuster 15 is configured with a pivoting (rotational) axis 16 about which the adjuster 15 can be rotated. The pivoting axis 16 is defined by means of two axles 16*a*, 16*b* which are attached in a pivoting manner in a support structure (not shown in FIG. 3) of the dispenser 2. It should be noted that the adjuster 15 can be mounted in the dispenser 2 after first having removed the liquid container 5 and the pump unit 3. When the adjuster 15 is mounted in the support structure, the liquid container 5 and the pump unit 3 may be installed again. Furthermore, the dispenser 2 is suitably configured so that the liquid container 5 will block access to the adjuster 15 when the dispenser 2 is closed. When the liquid container 5 is removed, by first unlocking the lock 8, the adjuster 15 will be easily accessed from the bottom of the dispenser 2. This arrangement is to prevent others than cleaning management staff from adjusting the dose setting, i.e. changing the position of the adjuster 15.

The first stroke length corresponds to the first position, which is a first rotational position of the adjuster 15, whereas the second stroke length corresponds to the second position, which is a second rotational position of the adjuster 15. The directions of rotation, i.e. for moving the adjuster 15 between its two positions, are also schematically indicated by means of arrows 20, 21 in FIG. 3. More precisely, when the adjuster 15 should be moved to a position corresponding to an actuated operating mode of the actuator 9 and the pump unit 3 in which a first (lower) dose volume is dispensed, it is moved in the direction of a first arrow 20. Conversely, when the adjuster 15 should be moved to a position corresponding to an actuated operating mode in which a second (higher) dose volume is dispensed, it is moved in the direction of a second arrow 21.

According to an embodiment, the adjuster 15 is generally rectangular. The rotational axis 16 extends along a first side of the rectangle. Additionally, the adjuster 15 has two side elements 15*a*, 15*b* and also a cross element 15*c*. Referring back to FIG. 2B, it is shown that the cross element 15*c* is aligned with the protrusion 14 on the rear side 9*c* of the actuator 9 when the adjuster 15 is positioned in its first rotational position. This means that the actuator 9 can only be pivoted so far that is allowed until the protrusion 14 reaches the cross element 15*c* of the adjuster 15. This can be used to define a relatively low dose volume when actuating the dispenser 2.

The cross element 15*c* may be used as a sort of handle in order for maintenance staff to change the position of the adjuster 15. In addition, the adjuster 15 comprises a further cross element 15*d* extending generally along the direction of the pivoting axis 16. The adjuster 15 is suitably manufactured from a slightly flexible plastics material, such as for example polyethylene or polypropylene.

Figure 3:
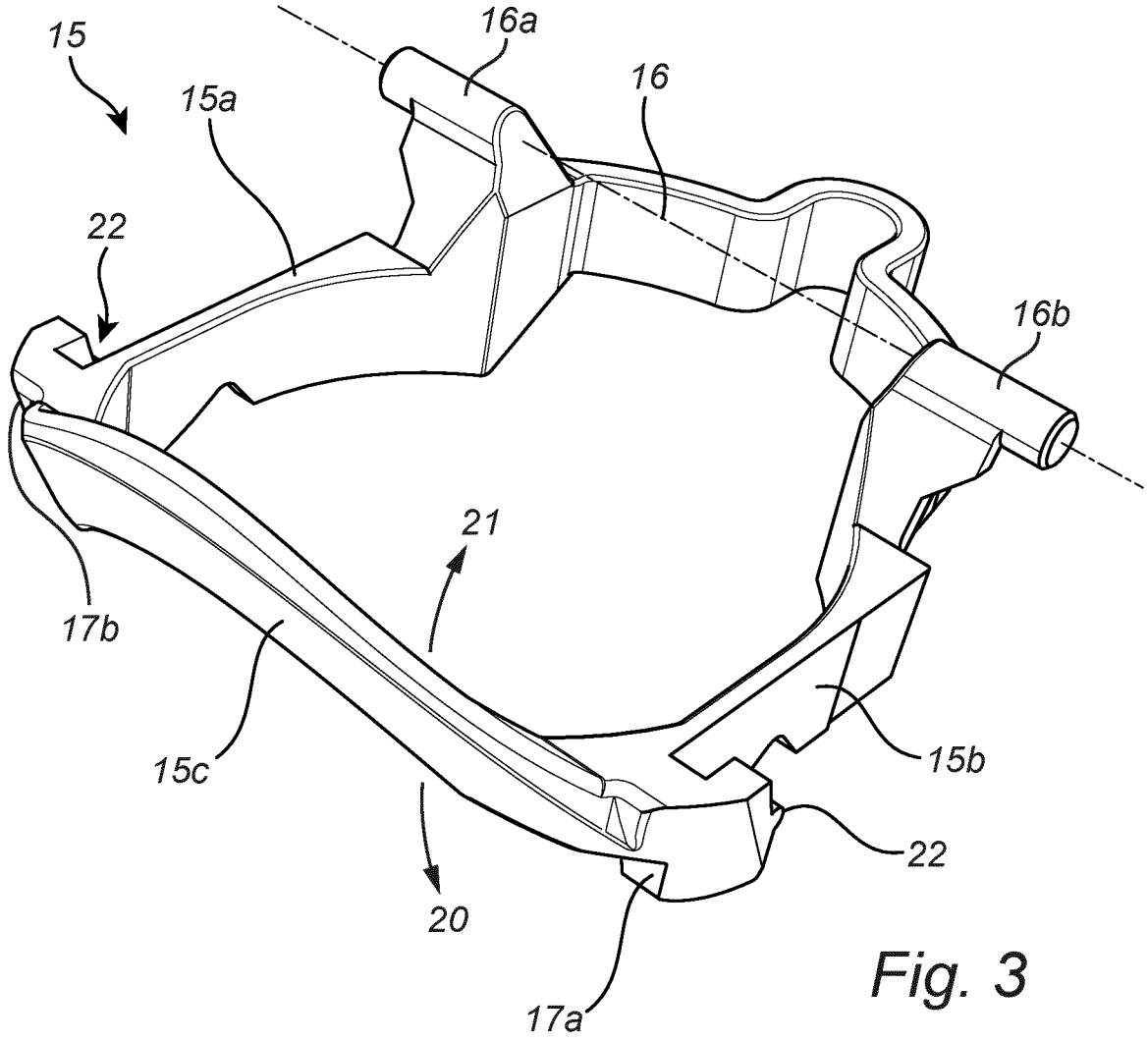
FIG. 3 shows a perspective view of an adjuster according to the disclosure.

As shown in FIG. 3 but not shown in any of FIGS. 2A, 2B, 2C, the adjuster 15 may be formed with two contact surfaces 17*a*, 17*b* which face the rear side 9*b* of the actuator 9. The first contact surface 17*a* is positioned in a manner so as to be aligned with the protrusion 14 on the rear side of the actuator 9, as also shown in FIG. 2. In a corresponding manner, the second contact surface 17*b* is positioned so as to be aligned with a further protrusion on the rear side 9*b* of the actuator 9, which however is not visible in the side views of FIGS. 2A, 2B, 2C.

Furthermore, the adjuster 15 can be pivoted so as to reach its second rotational position. In this position, the contact surfaces 17*a*, 17*b* will not be aligned with the corresponding protrusion 14. This means that the actuator 9 will be forcing the flange 13 forming part of the pump unit 3 a further distance upwards when the adjuster 15 is in the second rotational position, as compared with the first rotational position. This can be used to define a relatively high dose volume when actuating the dispenser 2.

Figure 4A:
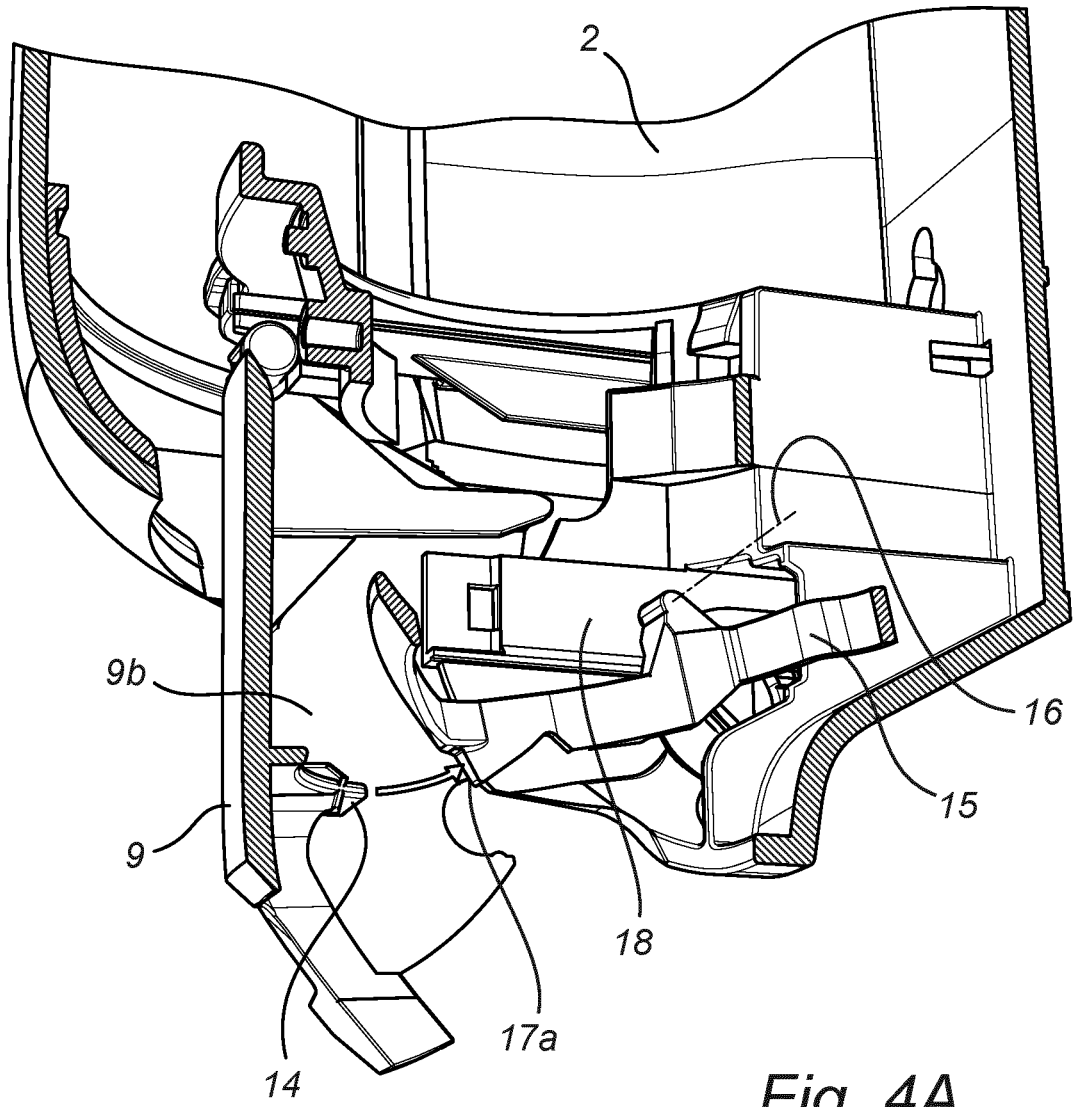
FIG. 4A shows a perspective view of an adjuster and an actuator according to the disclosure, in a first operating position.

FIG. 4A shows a perspective, cross-sectional view of the actuator 9 and the adjuster 15, showing in particular how the adjuster 15 is arranged with its pivoting axis 16 in a support structure 18 formed at the lower portion of the second portion 7 of the dispenser 2.

FIG. 4A shows in particular the adjuster 15 in its first rotational position in which the first contact surface 17*a* is aligned with the protrusion 14 on the rear side 9*b* of the actuator 9. In this position, the actuator 9 can be pivoted by a user so that the protrusion 14 approaches and finally comes into contact with the first contact surface 17*a*. This is indicated with an arrow in FIG. 4. This corresponds to a maximum displacement of the actuator 9 when the adjuster 15 is in its first position. This position defines a first displacement of the actuator 9, which means that a relatively low dose, e.g. in the magnitude, for example, of about 1.0 ml of liquid is dispensed from the dispenser.

The actuator 9 shown in FIG. 4A is displaced by a user by means of a pushing motion. Consequently, the actuator 9 translates a displacement effected by the user into a movement which corresponds to the stroke of the pump unit 3 and also to the amount of liquid which has been dispensed.

Figure 4B:
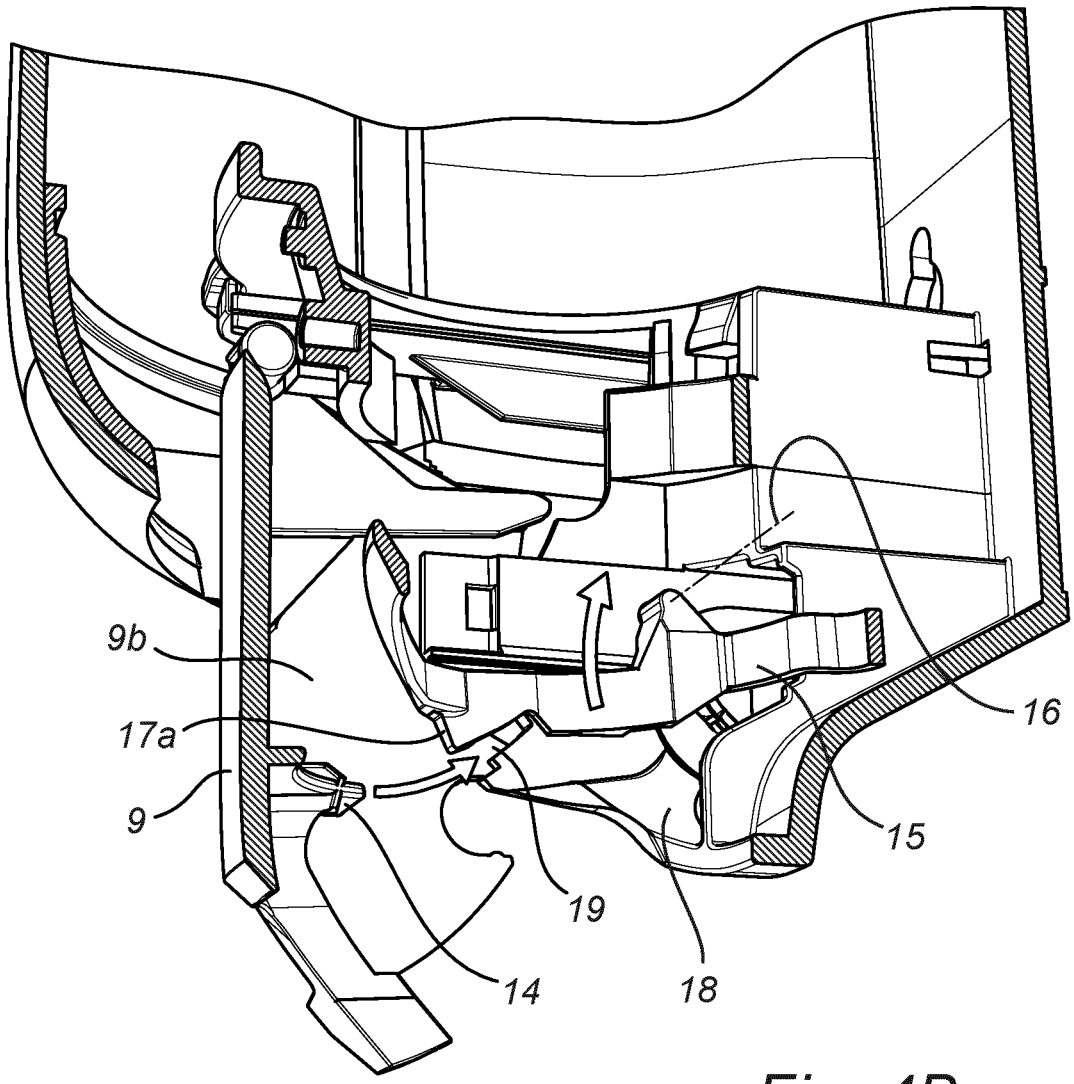
FIG. 4B shows the adjuster and actuator according to FIG. 4A in a second operating position.
Figure 5A:
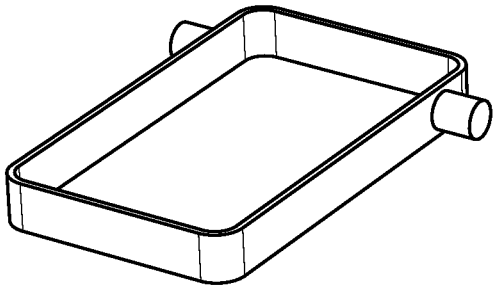
FIGS. 5A-D show certain embodiments of said adjuster.
Figure 5B:
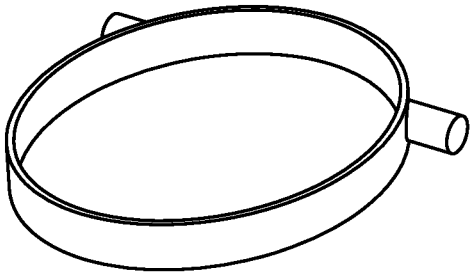
Figure 5C:
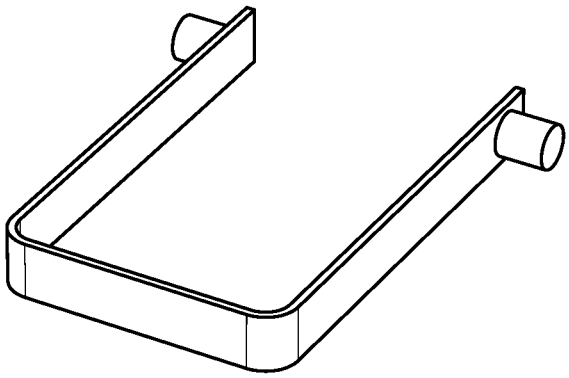
Figure 5D:
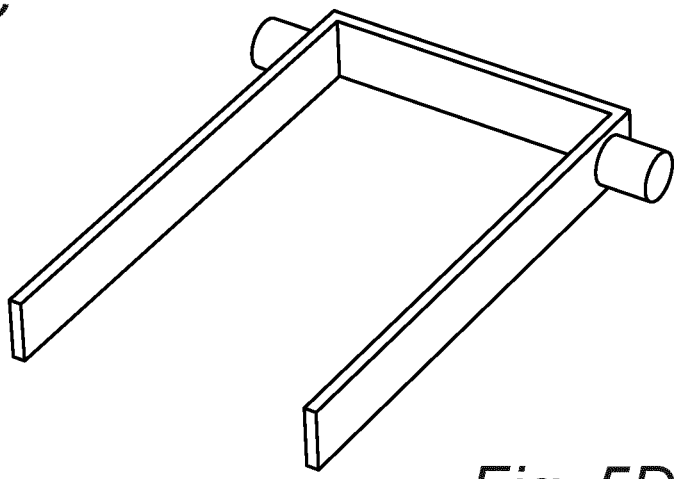

FIG. 4B shows a perspective cross-sectional view of the actuator 9 and the adjuster 15 in a view which generally corresponds to FIG. 4A but in which the adjuster 15 has been pivoted a certain amount in a clockwise direction as compared to FIG. 4. This corresponds to the second rotational position of the adjuster 15. In this position, the protrusion 14 will not come into contact with the first contact surface 17*a*. Instead, the actuator 9 can be pivoted further than the situation shown in FIG. 4A (i.e. in which the adjuster 15 is in its first position) so that the protrusion 14 will eventually reach a recess 19 which is formed in the support structure 18 of the dispenser 2. When the actuator 9 has been pivoted so far so that the protrusion 14 reaches into the recess 19, the pivoting movement corresponds to a second displacement length of the actuator 9. In this case, a relatively high dose of liquid, e.g. in the magnitude, for example, of about 1.6 ml of liquid is dispensed from the dispenser.

As shown in the embodiment of FIG. 4B, the second displacement length of the actuator 9 is limited by the protrusion 14 coming in contact with the innermost surface 19*a* of the recess 19. However, according to further embodiments, the second position can be determined in other ways, for example the actual maximum stroke length of the pump unit 3. Consequently, it may not be necessarily the configuration of the adjuster 15 which defines the displacement corresponding to the second position.

Furthermore, according to additional embodiments, the dispenser 2 can be arranged to provide more than two different positions, i.e. for providing more than two different dose volumes during use of the dispenser 2. The positions can be arranged in a stepwise manner or can alternatively be configured in the form of a continuously variable movement of the adjuster 15 between two end positions.

According to further embodiments, shown in FIGS. 5A, 5B, 5C and 5D, and as alternatives to the embodiment shown in FIG. 3, the adjuster 15 may be formed with other shapes, such as a square, circular or U-shaped configuration, with that U-shape being oriented so as to face either the front or rear of the dispenser 2.

Figure 6A:
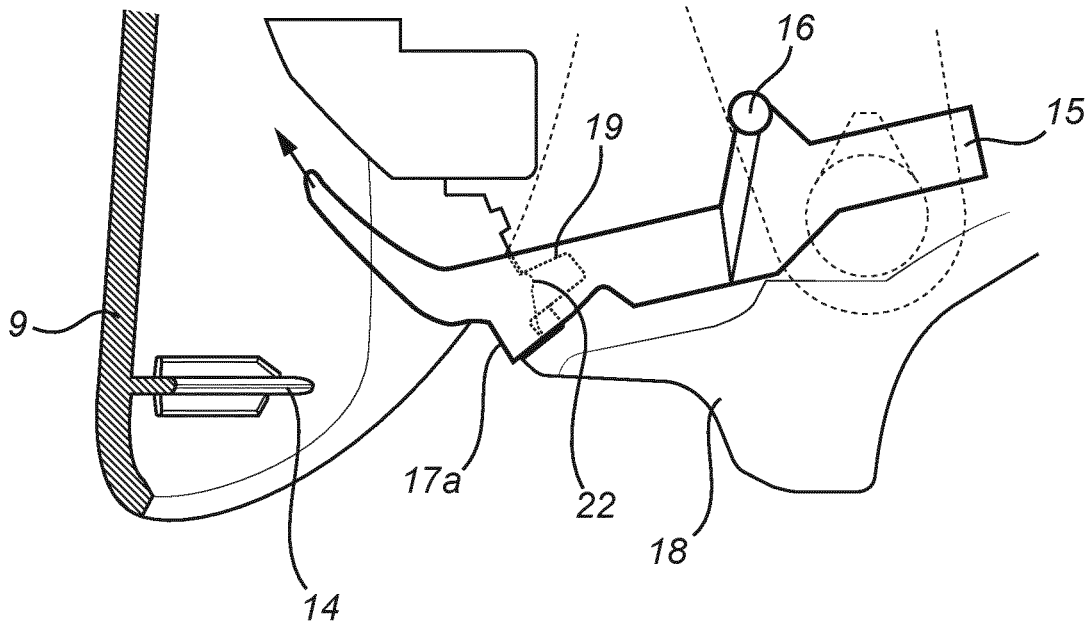
FIG. 6 shows a further view of an adjuster and actuator in which it is shown how the adjuster can be locked in a certain position.
Figure 6B:
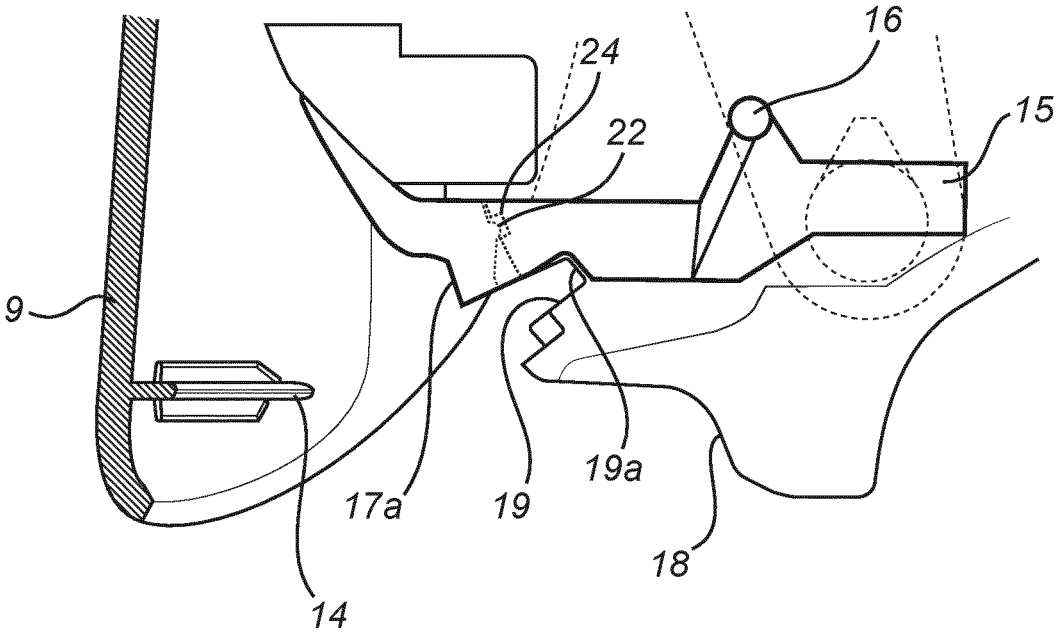

With reference to FIGS. 6A and 6B, there is shown two side views corresponding to FIGS. 4A and 4B, respectively, and indicating in particular how the adjuster 15 can be pivoted between its two positions. Also, FIGS. 6A and 6B show how the adjuster 15 can be releasably fixed in each one of these positions. As shown in FIG. 6A, the adjuster 15 is in its first position, i.e. corresponding to a relatively low dose of liquid being dispensed from the dispenser 2. In this position, the protrusion 14 is aligned with the first contact surface 17*a* so that the protrusion 14 will finally come into contact with the first contact surface 17*a* when a user pushes on the actuator 9. Also, this position of the adjuster 15 is maintained through the fact that a protruding part 22 of the actuator 9 is locked—in a fixed but releasable manner—into place in the recess 19 in the support structure 18. It should be noted that the protruding part 22, which is also shown in FIG. 3, is formed and positioned on the reverse side of each one of the contact surfaces 17*a*, 17*b* of the adjuster 15.

Furthermore, with reference to FIG. 6B, the adjuster 15 has been pivoted to its second rotational position in which the protrusion 14 will not be aligned to come into contact with the first contact surface 17*a*. Instead the protrusion 14 will be aligned with the recess 19, thereby allowing a longer movement of the actuator 9 and a relatively high dose of liquid being dispensed. When the adjuster 15 is in the position shown in FIG. 6B, the protruding part 22 will also be releasably locked, but within a further recess 24 in the support structure 18.

In summary, and as shown in FIGS. 6A and 6B, the adjuster 15 is movable between two rotational positions. In each one of these positions, the adjuster 15 can be locked, however in a releasable manner.

In summary, the dispenser 2 comprises the actuator 9 which is configured for manually activating the pump 3 for discharging liquid from the liquid container 10. The dispenser 2 also comprises an adjuster 15 for selectively limiting the displacement of the actuator 9 so as to define a predetermined dose volume during discharging of liquid.

Furthermore, the adjuster 15 is movable between at least the first position and the second position so that the adjuster 15 may act on the rear side 9*b* in the first position, in order to limit the displacement of the actuator 9 to a corresponding first displacement length. Also, the actuator 9 is configured with a second displacement length in the second position.

According to an embodiment, the second displacement length may be defined by the protrusion 14 being positioned within the recess 19. According to further embodiments, the second displacement length may be defined by the maximum stroke of the pump unit 3.

According to an embodiment, the lateral movement of the actuator 9 can be restricted by the adjuster 15 in at least one of its positions, which in turn affects the stroke length of the pump unit 3.

This disclosure also relates to a method for operating the dispenser system 1. Accordingly, the method may involve enabling a manual activation of the pump 3 by means of the actuator 9 so that liquid can be discharged from the liquid container 5. Also, a selective limitation of the displacement of the actuator 9 is enabled by means of the adjuster 15, so as to define a predetermined dose volume during the discharging of liquid. Furthermore, the method comprises a step of allowing movement of the adjuster 15 between at least a first position and a second position by selectively bringing the adjuster 15 to act on the rear side 9*b* of the actuator 9 in at least the first position, which corresponds to a first displacement length. Also, the second position corresponds to a second displacement length. In this manner, the displacement of the actuator 9 is limited to at least a corresponding first displacement stroke length and a second displacement length, respectively.

As shown for example in FIGS. 2A-C, the dispenser 2 is provided with the replaceable liquid container 5, i.e. in a condition in which the container 5 is positioned inside the housing 4. In this condition, the container 5 rests upon a bottom surface in the housing 4 and is arranged so that the pump unit 3 extends downwards. Also, the pump unit 3 is positioned behind the actuator 9 so that it may be activated mechanically by means of the actuator 9 when a user wishes to dispense soap. More precisely, and with further reference to FIG. 2A, it should be noted that the actuator 9 in that example embodiment is arranged in a pivotable manner in the dispenser 2. Also, the actuator 9 comprises a front surface 9*a* which is configured so that a user may push on it, and a pump actuator 9*c* (see FIG. 2A) which is configured so as be positioned below the annular flange 13 extending around the pump unit 3 when the actuator 9 is in a stand-by mode or condition.

When the user pushes on the front surface 9*a*, the actuator 9*c* will pivot in a counter-clockwise direction. This rotation forces the flange 13 in an upwards direction so as to actuate the pump unit 3 with a certain stroke. In a second position, shown in FIG. 2B, the pump actuator 9*c* has reached a further pivotal position in which the flange 13 has been forced to an upper position which corresponds to a condition in which foam has been pumped out via the dispensing opening 12.

The above-mentioned document WO 2011/133085 illustrates examples of how an actuation device can be operated to actuate a dispenser system.

The invention is not limited to the embodiments described above but can be varied within the scope of the appended claims.

Different liquids can be contemplated for use with the dispenser, dispensing systems, and methods described above. For example, and without limitation, it is contemplated that a liquid container 9 may contain a detergent, a disinfectant, a skin-care solution, a moisturizer, a sanitizer, a lotion, shampoo, or a medicament. The choice and composition of the liquid can be varied by the skilled person depending on the properties needed for the liquid and the desired result.

The invention claimed is:

1. A dispenser system comprising:

a dispenser comprising a housing and an actuator;

a liquid container disposed in the housing;

a pump operably connected to the dispenser; and an adjuster, wherein the actuator is configured to be manually operated to manually activate the pump to discharge liquid from said liquid container, wherein said actuator is formed with a front side and a rear side facing the rear of the dispenser, wherein the adjuster is configured to selectively limit a displacement of said actuator to define a corresponding predetermined maximum dose volume when the liquid is being discharged from the liquid container, wherein the adjuster is movable between at least a first position and a second position, wherein, when the adjuster is in the first position, the actuator has a displacement range of a first displacement length due to a cross element of the adjuster acting on said rear side of the actuator to block the actuator from being displaced beyond the first displacement length, wherein, when the adjuster is in the second position, the actuator has the displacement range of a second displacement length greater than the first displacement length due to the cross element of the adjuster not interfering with the actuator, and wherein the adjuster is pivotably arranged about a rotational axis and movable between at least two rotational positions corresponding to said at least first and second positions.

2. The dispenser system according to claim 1, wherein the rear side of the actuator is formed with at least one protrusion which is aligned to come into contact with the adjuster in at least one of the first and second positions, thereby defining the corresponding first displacement length of the actuator.

3. The dispenser system according to claim 2, wherein said second position corresponds either to a condition of the pump in which the pump has reached a maximum stroke length or to a condition in which a portion of the rear side of the actuator is aligned to come into contact with a support structure of the dispenser or with the adjuster, thereby limiting said second displacement length of the actuator.

4. The dispenser system according to claim 2, wherein the at least one protrusion is formed so that the second displacement length exceeds the first displacement length.

5. The dispenser system according to claim 1, wherein the adjuster comprises a front structure, a rear structure, and a pair of side structures that extend from the front structure to the rear structure in direction orthogonal to said rotational axis.

6. The dispenser system according to claim 5, wherein the front structure comprises the cross element extending between the side structures, the cross element being shaped so as to conform to said rear side of the actuator.

7. The dispenser system according to claim 1, wherein the adjuster comprises at least one contact surface which is configured to be in contact with said actuator in the first position of the adjuster.

8. The dispenser system according to claim 1, wherein said pump is an integrated pump unit in said liquid container and is actuated for discharging the liquid as a result of pressure being exerted upon the front side of the actuator.

9. The dispenser system according to claim 1, wherein the first position corresponds to a first dose of volume being dispensed, wherein the second position corresponds to a second dose of volume being dispensed, and wherein the second dose of volume is greater than the first dose of volume.

10. The dispenser system according to claim 1, wherein the actuator comprises a pump actuator element which is configured to actuate an annular flange on said pump unit, thereby initiating dispensing.

11. The dispenser system according to claim 1, wherein the liquid container is arranged so as to block access to the adjuster when the liquid container is mounted and the dispenser is closed.

12. A method for allowing operation of a dispenser system comprising a dispenser, a liquid container, a pump, and an adjuster, said method comprising:

enabling manual activation of the pump by a user via an actuator with a front side facing the user and a rear side facing the rear of the dispenser, so as to discharge liquid from said liquid container;

enabling selective limitation of the displacement of the actuator via the adjuster, thereby defining a corresponding predetermined dose volume during said discharging of the liquid;

allowing movement of the adjuster between at least a first position and a second position by selectively bringing the adjuster to act on said rear side of the actuator in at least the first position having a corresponding first displacement length, and wherein the second position corresponds to a second displacement length; and limiting the displacement of the actuator to at least the corresponding first displacement length and the second displacement length, respectively, wherein, when the adjuster is in the first position, the actuator has a displacement range of the first displacement length due to a cross element of the adjuster acting on said rear side of the actuator to block the actuator from being displaced beyond the first displacement length, wherein, when the adjuster is in the second position, the actuator has the displacement range of the second displacement length greater than the first displacement length due to the cross element of the adjuster not interfering with the actuator, and wherein the adjuster is pivotably arranged about a rotational axis and movable between at least two rotational positions corresponding to said at least first and second positions.

* * * * *